US011268750B1

(12) United States Patent
Hanson

(10) Patent No.: US 11,268,750 B1
(45) Date of Patent: Mar. 8, 2022

(54) ON DOOR DRAWER AND REFRIGERATING APPLIANCE WITH SAME

(71) Applicant: Electrolux Home Products, Inc., Charlotte, NC (US)

(72) Inventor: Josh Hanson, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/133,064

(22) Filed: Dec. 23, 2020

(51) Int. Cl.

| | |
|---|---|
| ***F25D 23/04*** | (2006.01) |
| ***F25D 25/02*** | (2006.01) |
| ***F25D 17/04*** | (2006.01) |
| ***F25D 23/02*** | (2006.01) |

(52) U.S. Cl.
CPC ..... *F25D 23/04* (2013.01); *F25D 17/042* (2013.01); *F25D 23/028* (2013.01); *F25D 25/025* (2013.01); *F25D 2317/0413* (2013.01)

(58) Field of Classification Search
CPC ..... F25D 23/04; F25D 17/042; F25D 23/028; F25D 25/025; F25D 2317/0413
See application file for complete search history.

(56) References Cited

U.S. PATENT DOCUMENTS

| | | | | |
|---|---|---|---|---|
| 2,096,690 | A | 10/1937 | Scofield | |
| 2,646,332 | A | 7/1953 | Phillip | |
| 4,186,978 | A * | 2/1980 | Thomson | F25D 23/04 211/80 |
| 5,366,285 | A | 11/1994 | Borgen | |
| 6,782,710 | B2 * | 8/2004 | Eveland | F25D 11/02 312/404 |
| 7,467,834 | B2 | 12/2008 | Kim et al. | |
| 8,517,483 | B2 * | 8/2013 | Eubanks | F25D 17/042 312/404 |
| 8,522,566 | B2 * | 9/2013 | Leclear | F25D 23/04 62/137 |
| 8,864,252 | B1 * | 10/2014 | Rodriguez Cobas | F25D 23/04 312/405.1 |
| 9,328,955 | B2 | 5/2016 | Castro Solis et al. | |
| 9,581,377 | B2 | 2/2017 | Kim et al. | |
| 9,903,641 | B1 * | 2/2018 | Shrader | F25D 25/025 |

(Continued)

FOREIGN PATENT DOCUMENTS

| | | |
|---|---|---|
| CN | 105783405 | 1/2005 |
| CN | 103776229 | 5/2014 |

(Continued)

*Primary Examiner* — Hanh V Tran
(74) *Attorney, Agent, or Firm* — Pearne & Gordon LLP

(57) ABSTRACT

A refrigerating appliance including a cabinet, a door pivotally mounted onto a front of the cabinet, a crisper frame mounted to an inside surface of the door, the crisper frame comprising a back wall and two side walls and an intermediate wall forming two drawer compartments, a roof, the roof including vents over each drawer compartment, and an upper shelf lying above the roof section and connected to the crisper frame at each of the two side walls, wherein the upper shelf includes a pocket, wherein the roof includes a chimney opening near the vertical intermediate wall connecting the two drawer compartments with the pocket; and two crisper drawers, each crisper drawer configured to removably fit within one of the two drawer compartments and comprising two side walls, a back wall, a front wall and a bottom wall is provided.

19 Claims, 8 Drawing Sheets

(56) References Cited

U.S. PATENT DOCUMENTS

| | | | | |
|---|---|---|---|---|
| 10,151,525 | B2 * | 12/2018 | Shrader | F25D 25/025 |
| 2002/0117947 | A1 * | 8/2002 | Cheng | A47B 87/008 312/327 |
| 2003/0061938 | A1 * | 4/2003 | Kunstadt | B01D 53/22 96/4 |
| 2006/0250063 | A1 * | 11/2006 | Czach | F25D 25/00 312/405.1 |
| 2007/0113578 | A1 * | 5/2007 | Wu | F25D 23/04 62/344 |
| 2007/0126325 | A1 | 7/2007 | Gorz et al. | |
| 2013/0119846 | A1 * | 5/2013 | Seo | F25D 23/04 312/404 |
| 2014/0053592 | A1 * | 2/2014 | Allard | F25D 25/025 62/441 |
| 2014/0312758 | A1 * | 10/2014 | Gossens | F25D 23/04 312/404 |
| 2015/0176887 | A1 * | 6/2015 | Castro Solis | F25D 25/025 312/405.1 |
| 2016/0341468 | A1 * | 11/2016 | Joo | F25D 23/126 |
| 2017/0167778 | A1 * | 6/2017 | Lee | F25D 23/067 |
| 2017/0198963 | A1 | 7/2017 | Hanson et al. | |
| 2017/0367478 | A1 * | 12/2017 | Ahmedov | F25D 25/025 |
| 2018/0031309 | A1 * | 2/2018 | Kim | F25D 25/024 |
| 2018/0038630 | A1 * | 2/2018 | Biotti | F25D 25/025 |
| 2018/0372394 | A1 * | 12/2018 | Kim | F25D 23/028 |
| 2019/0041122 | A1 * | 2/2019 | Bento | F25D 23/04 |
| 2020/0072530 | A1 * | 3/2020 | Zhu | F25D 11/02 |
| 2020/0166272 | A1 * | 5/2020 | Li | F25D 23/028 |
| 2021/0131721 | A1 * | 5/2021 | Kelly | B01D 46/0006 |
| 2021/0247123 | A1 * | 8/2021 | Dubina | F25D 17/045 |

FOREIGN PATENT DOCUMENTS

| | | | | |
|---|---|---|---|---|
| EP | 1429095 | | 12/2003 | |
| EP | 1484564 | | 12/2004 | |
| EP | 2072937 | | 6/2009 | |
| EP | 3771870 | A1 * | 2/2021 | B01D 46/0006 |
| EP | 3772625 | A1 * | 2/2021 | F25D 17/045 |
| JP | H04186084 | | 7/1992 | |
| JP | H11118344 | | 4/1999 | |
| JP | 2003262460 | | 9/2003 | |
| JP | 2015117851 | | 6/2015 | |
| WO | WO2005001353 | | 1/2005 | |
| WO | WO2006/024652 | | 3/2006 | |
| WO | WO2006126106 | | 11/2006 | |

* cited by examiner

ON DOOR DRAWER AND REFRIGERATING APPLIANCE WITH SAME

FIELD OF THE INVENTION

This application relates generally to an on-door drawer in a refrigerating appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

These conventional refrigeration appliances have solid, insulated doors that close the respective compartment(s). The doors are heavily insulated to aid in maintaining the temperature within the compartment(s) within an acceptable temperature range. The interior surfaces of these doors are clothed in a door liner. The door liner may include lugs, pegs or other mechanisms to permit shelves to be mounted on the door liner.

Certain types of food stored in a fresh food compartment benefit from an optimized humidity. For example, a high humidity may be desirable for storing leafy or root vegetables in order to limit evaporation. In contrast, storage of fruit and packaged dry goods may benefit from a lower humidity. Likewise, different goods stored in a freezer compartment may benefit from subtle temperature variations. For example, long term storage of frozen meats may benefit from a lower freezing temperature, while storage of prepared goods, such as ice cream, may benefit from storage at a slightly higher, yet freezing, temperature.

SUMMARY OF THE INVENTION

The instant invention is an assembly for an on-door drawer, the drawer functioning as a crisper when located in a fresh food compartment and further including a top mounted shelf.

In a first embodiment, the invention provides a refrigerating appliance comprising a cabinet; a door pivotally mounted onto a front of the cabinet; a crisper frame mounted to an inside surface of the door, the crisper frame comprising a back wall and two side walls and an intermediate wall forming two drawer compartments, a roof section which curves downwardly and backwardly from a front upper edge of the crisper frame, the roof section including vents over each drawer compartment, and an upper shelf lying above the roof section and connected to the crisper frame at each of the two side walls; wherein the upper shelf includes a pocket with a cover; wherein the roof section includes opening near the vertical intermediate wall and communicating with a chimney structure connecting the two drawer compartments with the pocket; and two crisper drawers, each crisper drawer configured to removably fit within one of the two drawer compartments and comprising two side walls, a back wall, a front wall and a bottom wall.

In another embodiment, the invention provides the refrigerating appliance according to any embodiment herein and further wherein the pocket houses a packet containing one or more of ethylene absorbers, anti-oxidants and odor absorbers In another embodiment, the invention provides the refrigerating appliance according to any embodiment herein and wherein the roof section includes slots forming a communication vent between the crisper drawers and a space between the roof section and a lower surface of the upper shelf.

In another embodiment, the invention provides the refrigerating appliance according to any embodiment herein and further comprising a permeable membrane on all or part of an upper surface of the roof section.

In another embodiment, the invention provides the refrigerating appliance according to any embodiment herein and further comprising a permeable membrane along all or part of an outer back surface of the crisper frame.

In another embodiment, the invention provides the refrigerating appliance according to any embodiment herein and further comprising a lift off bin configured to fit on top of the upper shelf.

In another embodiment, the invention provides the refrigerating appliance according to any embodiment herein and further comprising an upwardly extending lug located on each back corner of the upper shelf, and wherein the lift off bin comprises two side walls, back and front walls and a bottom wall, wherein each side wall includes an indentation configured to interlock with one of the upwardly extending lugs.

In another embodiment, the invention provides the refrigerating appliance according to any embodiment herein and further comprising a plurality of vertical rib pairs on the front and back walls, wherein each rib pair is configured to interlock with a removable bin spacer.

In another embodiment, the invention provides the refrigerating appliance according to any embodiment herein and wherein all or part of a forward upper edge of the crisper frame further comprises a sealing material.

In another embodiment, the invention provides the refrigerating appliance according to any embodiment herein and wherein the front face of each crisper drawer further comprises a handle along a top edge of the front wall of the crisper drawer.

In another embodiment, the invention provides the refrigerating appliance according to any embodiment herein and wherein each side wall of each crisper drawer further comprises an outwardly extending dowel at a lower front portion of the side wall, each dowel configured to interlock with niches in the side walls and intermediate wall of the crisper frame.

In another embodiment, the invention provides the refrigerating appliance according to any embodiment herein and wherein each side wall of each crisper drawer further comprises an outwardly extending dowel at an upper back portion of the side wall, each dowel configured to fit and move within a track located on the side walls and intermediate wall of the crisper frame.

In another embodiment, the invention provides the refrigerating appliance according to any embodiment herein and wherein the tracks are curved, thereby allowing the crisper drawer to tilt forward and backward to open and close the crisper drawer.

In another embodiment, the invention provides the refrigerating appliance according to any embodiment herein and wherein each niche in the side walls and intermediate wall of the crisper frame include an open upper surface, thereby allowing the crisper drawer to be lifted up and removed from the crisper frame.

In another embodiment, the invention provides the refrigerating appliance according to any embodiment herein and wherein the cover is configured to securely and removably house the packet.

In another embodiment, the invention provides the refrigerating appliance according to any embodiment herein and wherein the door includes a door liner with two side walls, each side wall including one or more pegs and wherein an outer surface of the crisper frame further comprises indentations configured to interlock with the pegs, thereby making the crisper frame removable from the door, In another embodiment, the invention provides the refrigerating appliance according to any embodiment herein and wherein the side walls, front wall, back wall and bottom wall of each crisper drawer is constructed of a transparent material.

In another embodiment, the invention provides the refrigerating appliance according to any embodiment herein and wherein the handle is made of extruded aluminum.

In yet another embodiment, the invention provides a refrigerating appliance in accordance with any of the embodiments herein and wherein the refrigerating appliance is a freezer compartment. In a particular embodiment, the crisper drawer in a freezer compartment functions as a soft serve or soft freeze drawer.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

FIG. 7*a* illustrates the presence of the permeable membrane 70 while FIG. 7*b* shows the top surface of roof 51 in the absence of a permeable membrane.

DETAILED DESCRIPTION OF EMBODIMENTS OF THE INVENTION

Figure 1:
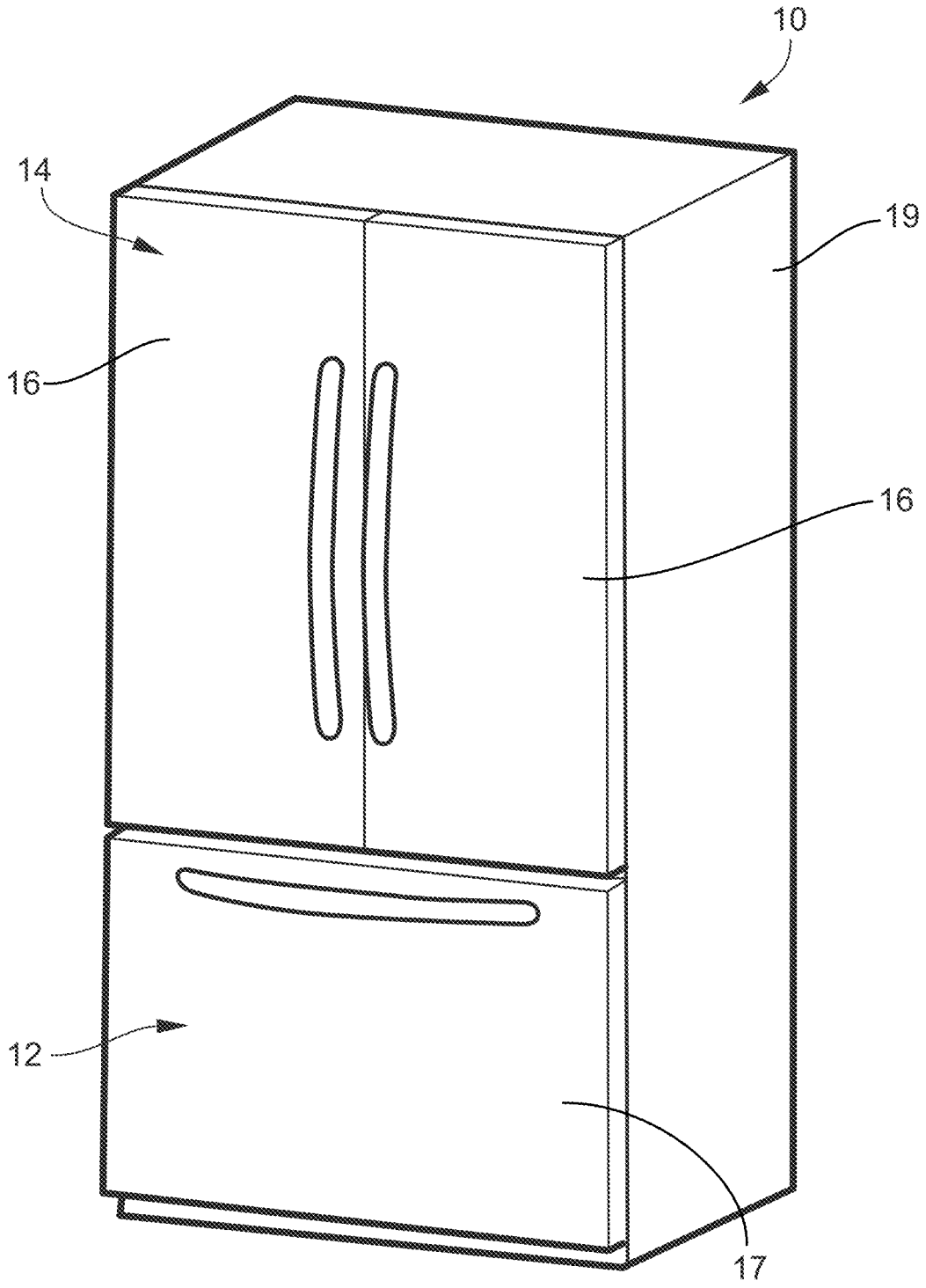
FIG. 1 is a front perspective view of a prior art household refrigeration appliance showing doors of the fresh food and freezer compartments in closed positions.

Embodiments of a refrigerating appliance or a component thereof now will be described with reference to the accompanying drawings. Whenever possible, the same reference numerals are used throughout the drawings to refer to the same or like parts.

Referring to FIG. 1, a standard domestic refrigeration appliance is indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including a top-mount refrigerator (i.e., fresh food compartment disposed vertically below the freezer compartment), a side by side refrigerator (i.e., fresh food compartment disposed laterally adjacent the freezer compartment), a single compartment refrigerator (i.e., having only a fresh food compartment or a freezer compartment), refrigerators including variable climate zone compartments, etc One or more doors 16 shown in FIG. 1 are pivotally coupled to a cabinet 19 of the refrigerator 10 to restrict and grant access to the fresh food compartment 14. The door can include a single door that spans the entire lateral distance across the entrance to the fresh food compartment 14, or can include a pair of French-type doors 16 that collectively span the entire lateral distance of the entrance to the fresh food compartment 14 to enclose the fresh food compartment 14. In the refrigerating appliance configuration shown in FIG. 1, the freezer compartment 12 is positioned above the fresh food compartment 14. As shown in FIG. 1, the freezer compartment 12 is enclosed in this instance by a sliding door 17.

Figure 2:
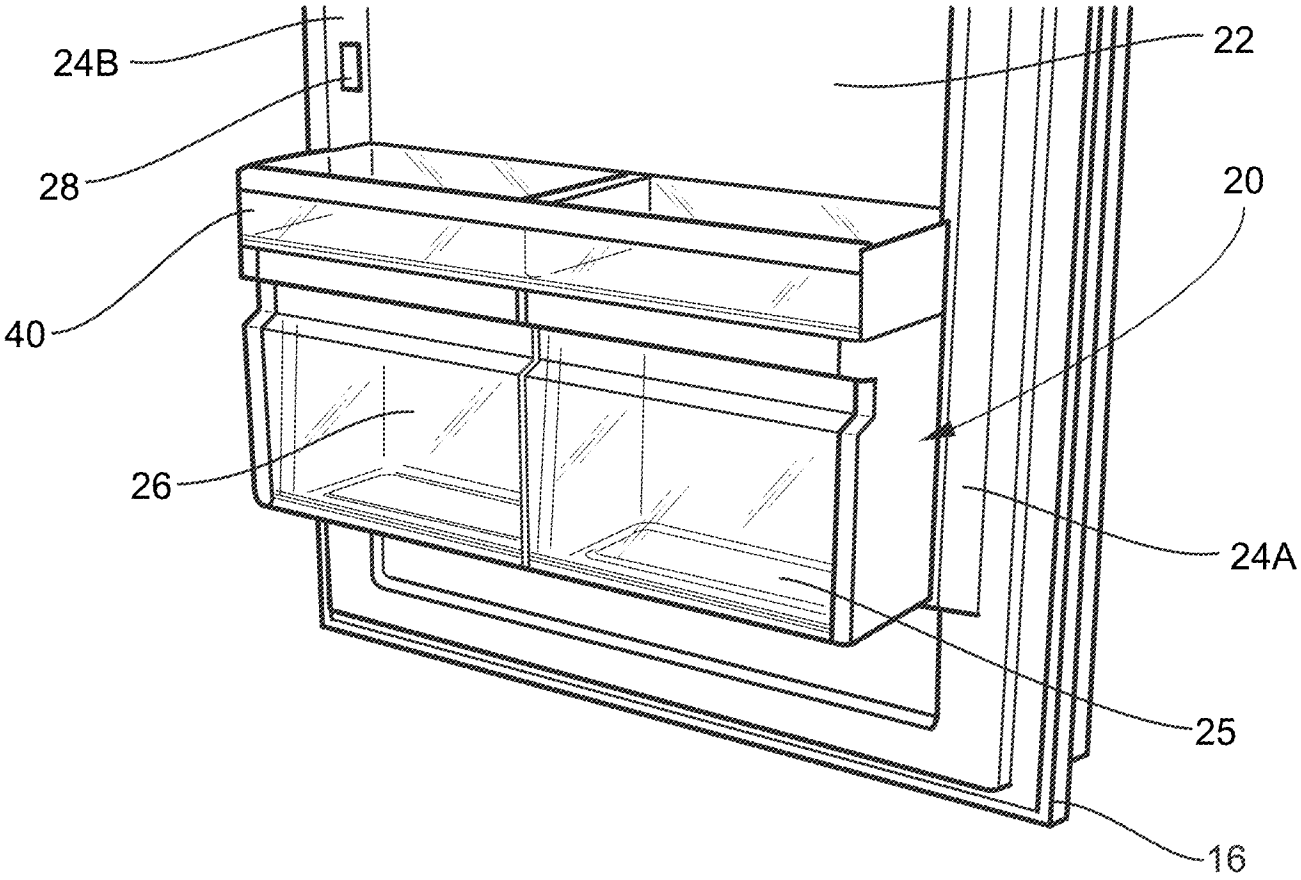
FIG. 2 is a front perspective view of a first embodiment of an on-door drawer used in a fresh food compartment of a refrigerating appliance.
Figure 3:
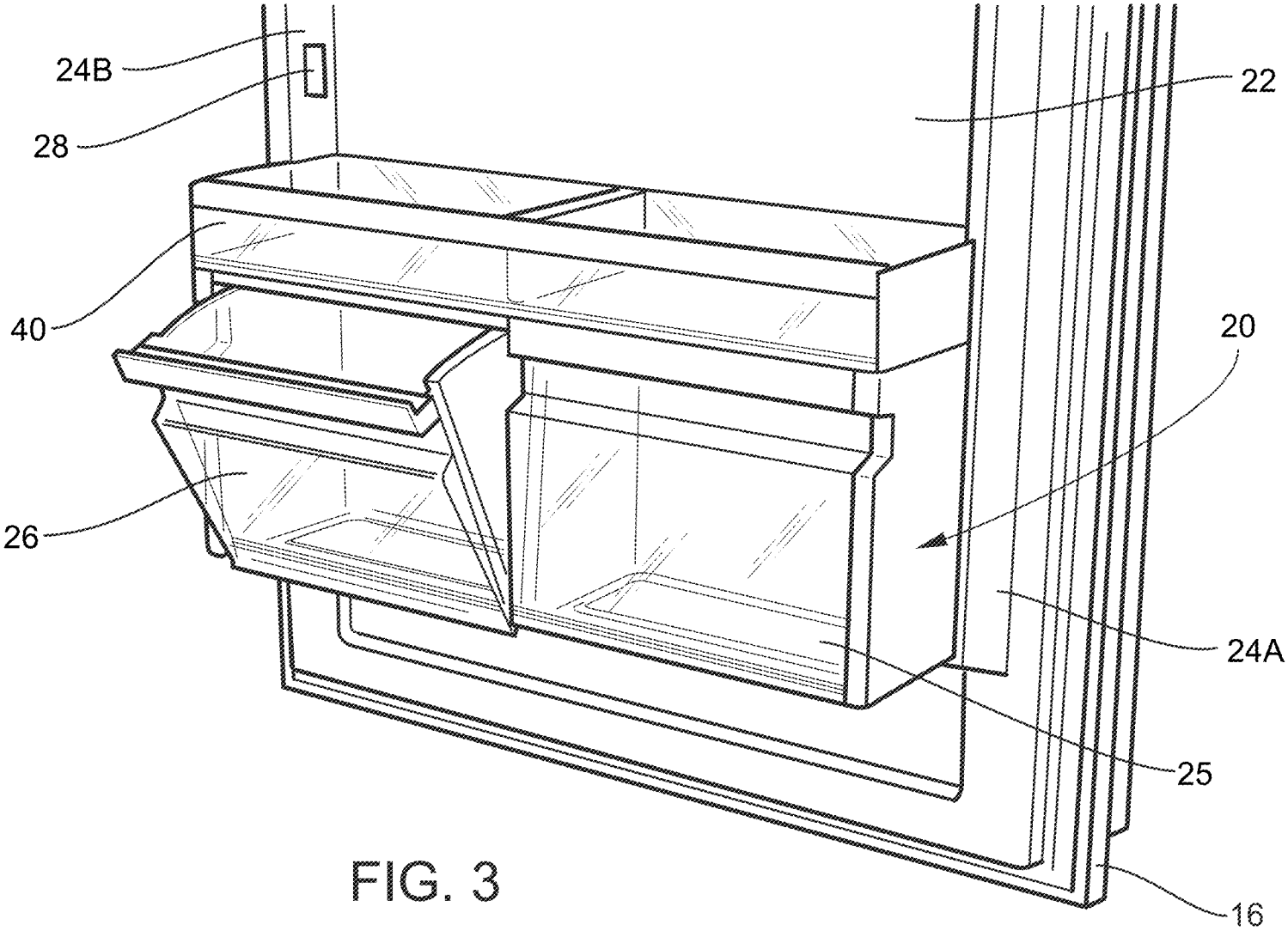
FIG. 3 is a front perspective view of a first embodiment shown in FIG. 2 wherein the left side drawer is in an open position.
Figure 4:
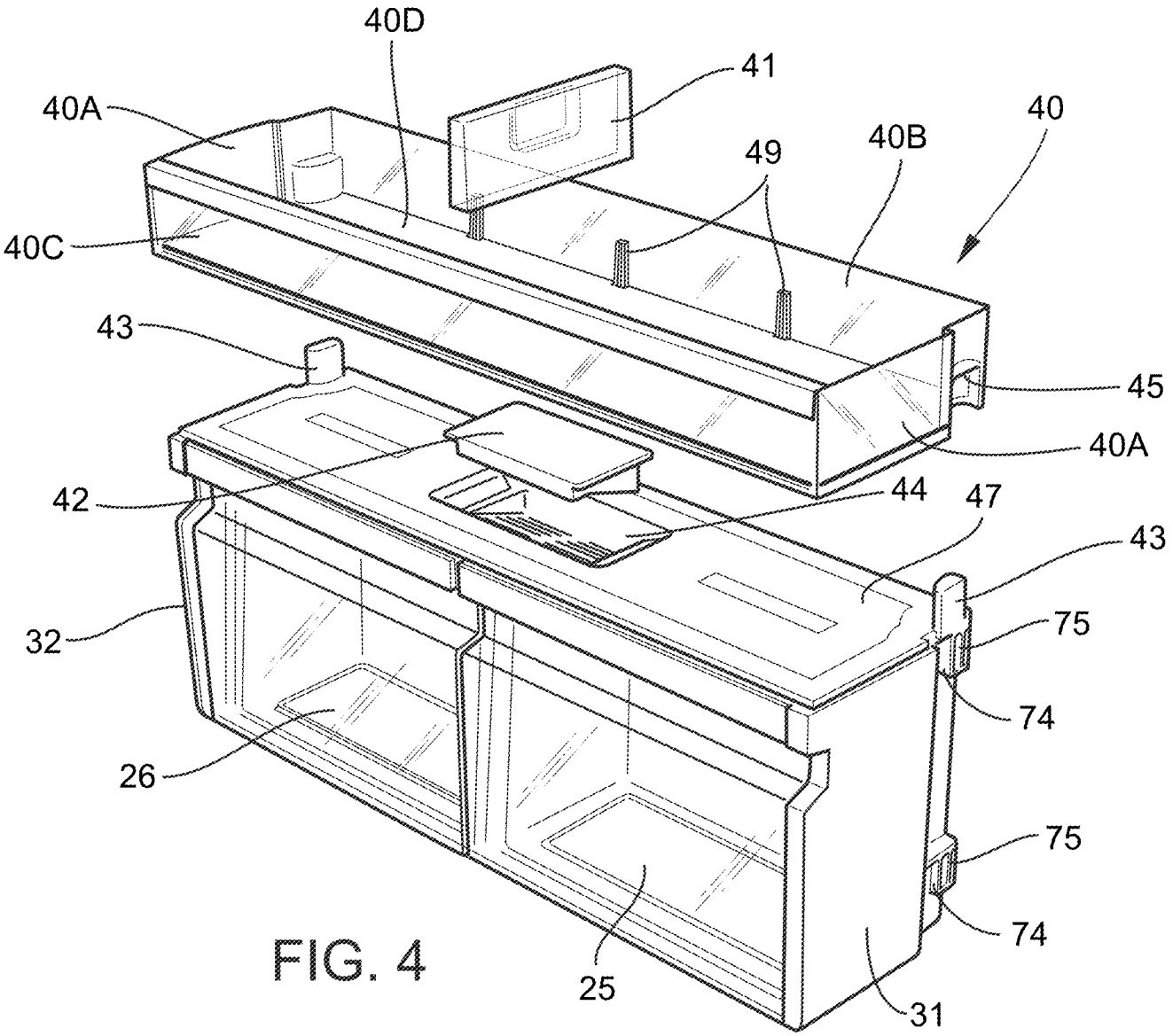
FIG. 4 is a front perspective partially exploded view of the embodiment shown in FIG. 2 wherein the on-door drawer is not installed in a refrigerating appliance.

Referring now to FIG. 2, a fully assembled and installed on-door drawer 20 is illustrated in front perspective view as installed on a fresh food compartment door. FIG. 3 illustrates the on-door drawer with a left hand drawer open. FIG. 4 illustrates a partially exploded view of the on-door drawer of FIGS. 2 and 3. As seen in FIGS. 2 and 3, the on-door drawer 20 is mounted onto a refrigerator door liner 22. The refrigerator door liner 22 clads an inside surface of the refrigerator door 16. In a preferred embodiment, the on-door drawer is removably mounted onto the door liner 22. The door liner 22 includes a right side flange 24*a* and a left side flange 24*b*. Pegs 28 may be integrally molded onto the side flanges 24*a* and 24*b*. The on-door drawer further includes a left crisper drawer 26 and a right crisper drawer 25, and a lift off bin 40, As seen in FIG. 4, the on-door drawer 20 is made of a frame 30 which in turn is made of a back wall 71 (not shown in FIG. 4) and a right side wall 31, a left side wall 33, and an intermediate wall 32 (not shown in FIG. 4). Spanned by the left side wall 33 and the intermediate wall 32 is a left side drawer compartment. Spanned by the right side wall 31 and the intermediate wall 32 is a right side drawer compartment. The left crisper drawer 26 is housed within the left side drawer compartment and the right crisper drawer 25 is housed within the right side drawer compartment.

Figure 5:
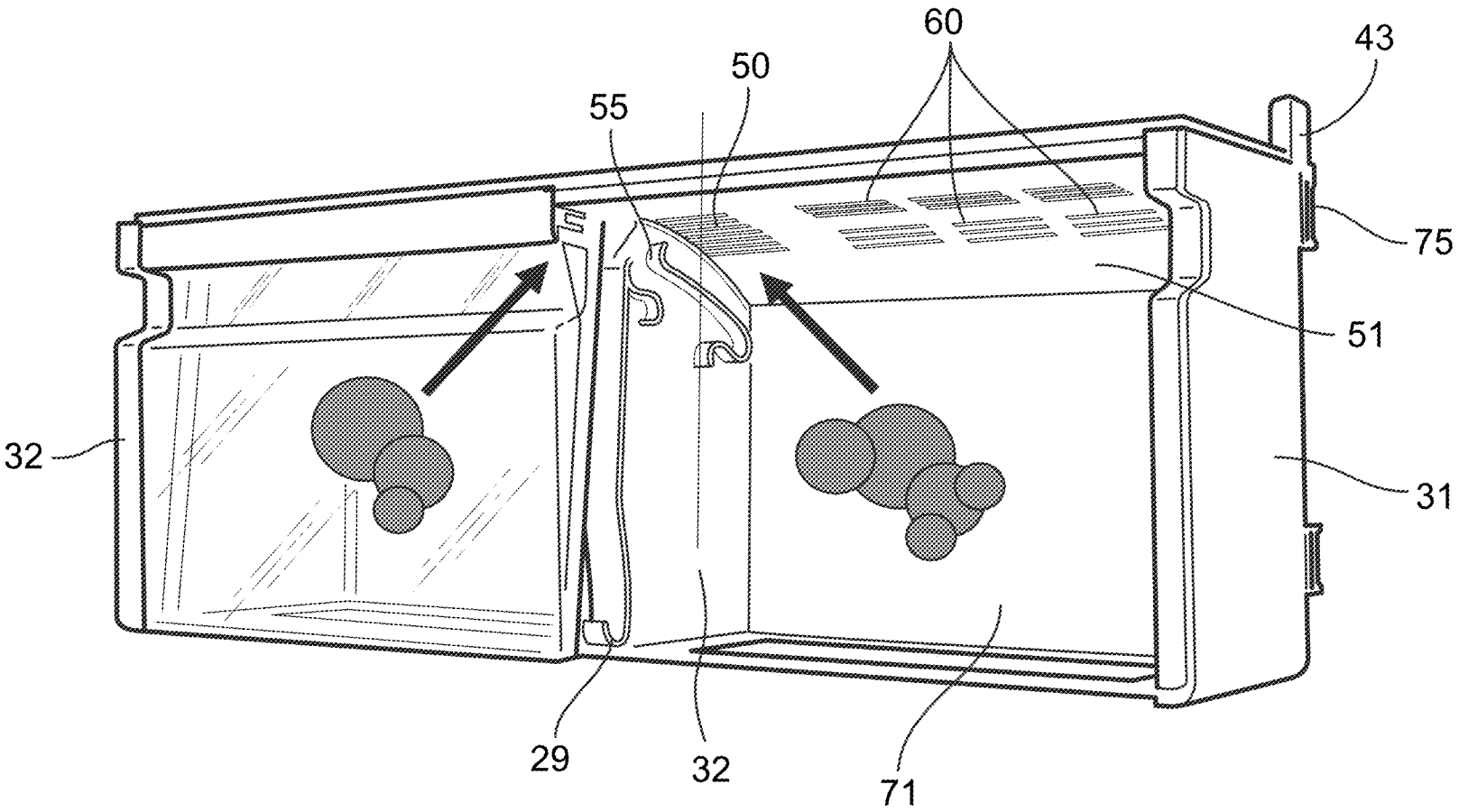
FIG. 5 is a front perspective view of an embodiment of the crisper frame, uninstalled in a refrigerating appliance, with no drawer installed in one of the drawer compartments and showing the chimney and forming a communication vent between the crisper drawers and a space between the roof section and a lower surface of the upper shelf and schematically illustrating the evolution of ethylene gas into the chimney.
Figure 6:
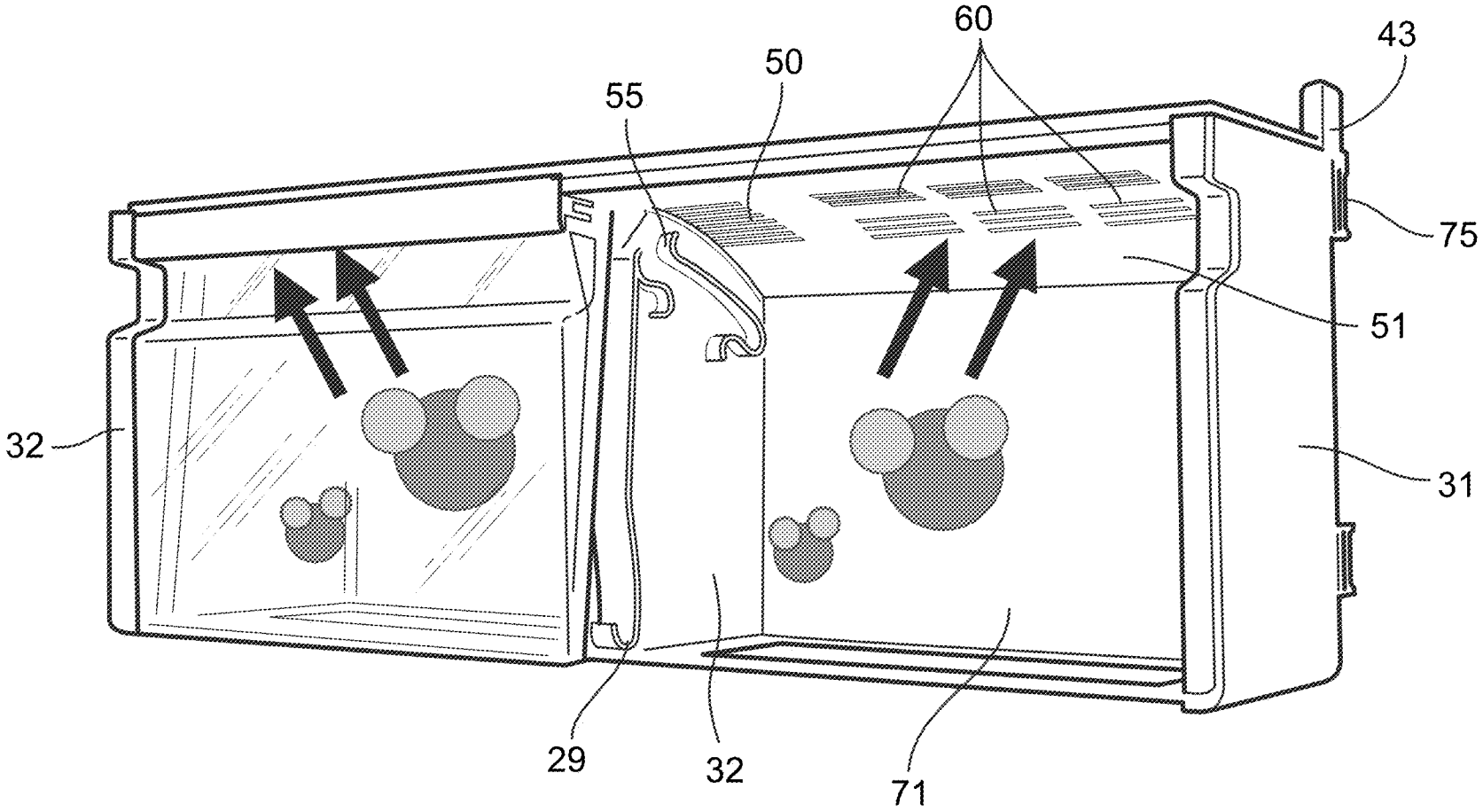
FIG. 6 is a front perspective view of an embodiment of the crisper frame, uninstalled in a refrigerating appliance, as shown in FIG. 5 and schematically illustrating the evolution of humidity.
Figure 7A:
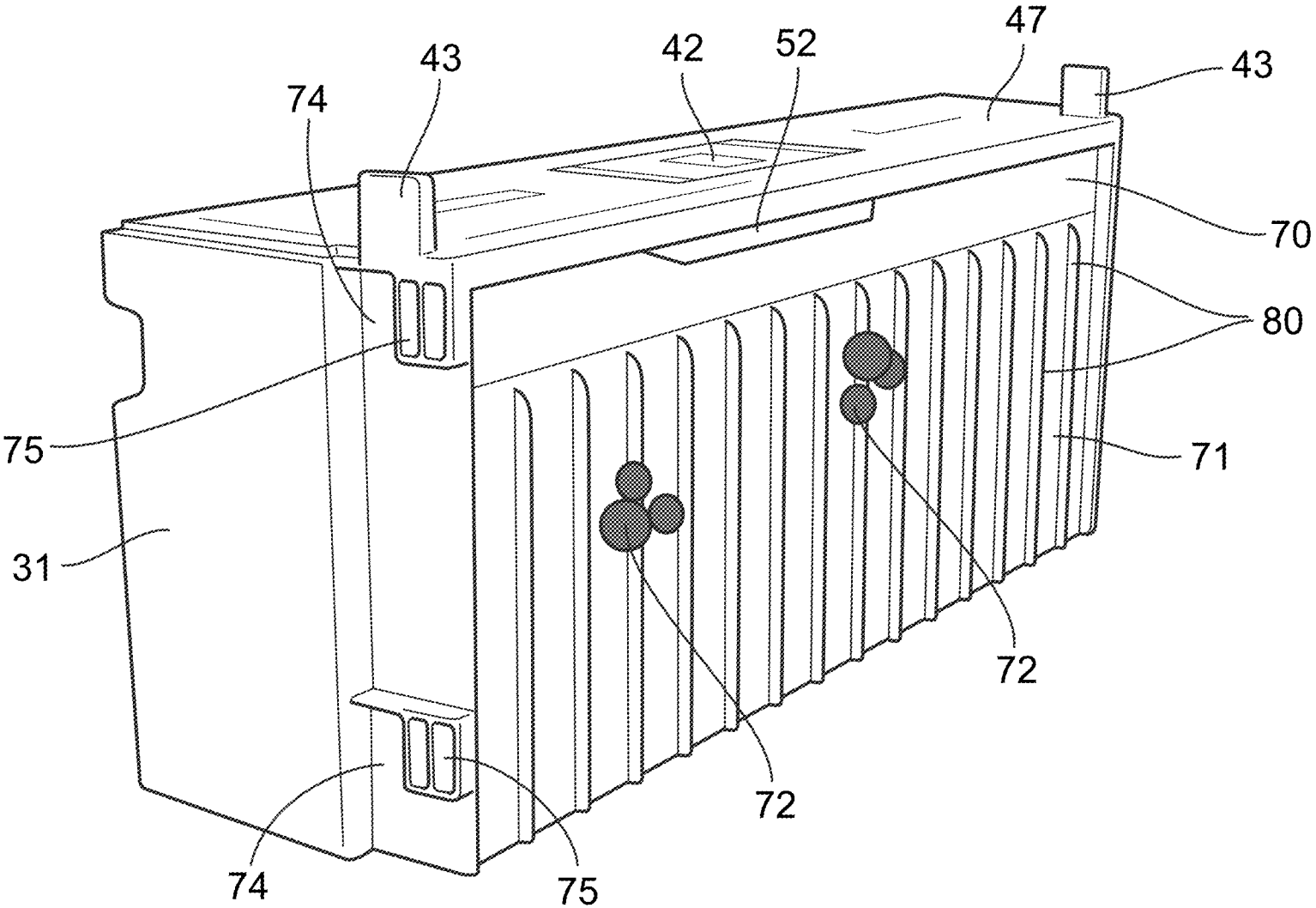
FIGS. 7*a* and 7*b* are rear perspective views of one embodiment of the crisper frame.
Figure 7B:
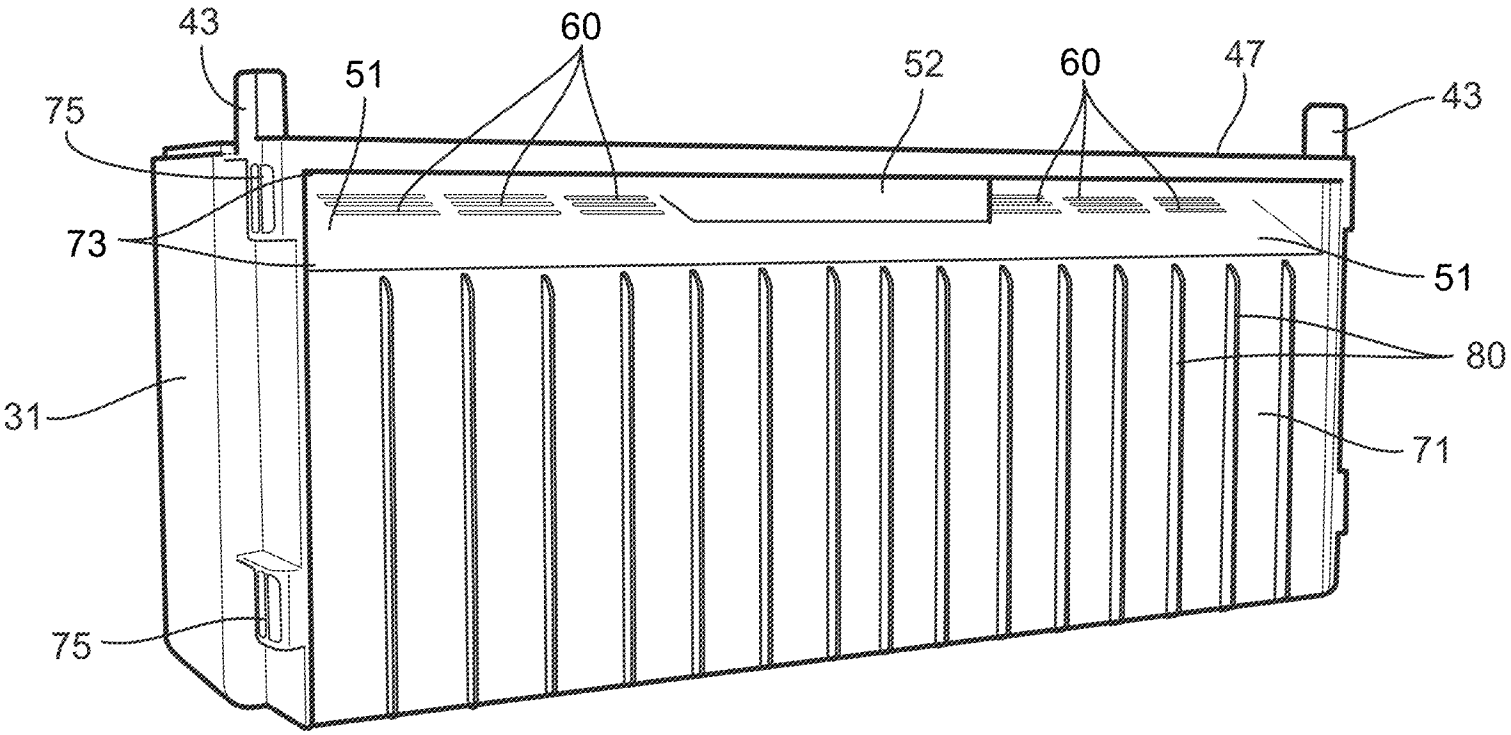

Referring to FIGS. 5 and 6, a roof 51 is shown at the top of the right side drawer compartment. The roof 51 extends across the width of frame 30 from the right side wall 31 to the left side wall 33, over intermediate wall 32. FIGS. 7*a* and 7*b* show a rear view of the frame 30, including the roof 51. In the particular embodiment shown, the roof 51 is curved. Specifically, from the upper front edge of frame 30, the curved roof 51 extends gradually downward until it joins a back wall 71 of the frame 30. An upper shelf 47 extends from right side wall 31 to left side wall 33 at a distance spaced apart and above curved roof 51. The distance between roof 51 and a bottom surface of upper shelf 47 forms an open space 73. In other embodiments, the roof 51 is not curved but rather is planar.

Roof 51 includes vents 60 forming a fluid communication between the right side drawer compartment and open space 73. Vents 60 are also present in roof 51 in the left side drawer compartment, thereby forming a fluid communication between the left side drawer compartment and open space 73. Vents 60 allow moisture to migrate from the right side and left side drawer compartments into the open space 73. While vents 60 are illustrated as elongated ovals in FIGS. 5 and 6, vents 60 may take any shape or size consistent with permitting passage of excess humidity and frame structural integrity. For example, vents 60 may be square, rectangular, circular, oval, or polygonal.

Referring to FIG. 6, roof 51 further includes at least one chimney opening 50 in each of the right side drawer compartment and the left side drawer compartment and located near the intermediate wall 32. Chimney openings 50 communicate with a chimney 52 (FIGS. 7*a* and 7*b*). Chimney 52 forms an enclosed fluid passage between each of the drawer compartments and pocket 44 (FIG. 4) formed in the upper shelf 47. Chimney openings 50 and chimney 52 permit passage of ethylene gas from the right and left side drawer compartments into pocket 44. In some embodiments, pocket 44 houses a packet containing one or more of ethylene absorbers, anti-oxidants and odor absorbers, such as carbon. Such materials may be enclosed in a permeable packet or envelope. In some embodiments of the inventive on-door drawer 20, pocket 44 may include a removable cover 42.

In some embodiments of the on-door drawer 20, a top surface of roof 51 is at least partially covered with a permeable membrane 70. FIG. 7*a* illustrates the presence of the permeable membrane 70 while FIG. 7*b* shows the top surface of roof 51 in the absence of a permeable membrane. Permeable membrane 70 may be any film which attracts and condenses water vapor. Such permeable membranes may be made of TYVEK, TESLIN, high-density spunbound polyethylene fibers, flash spun high density polyethylene, nonwoven polypropylene, and combinations of spun bound and melt blown polyolefins. Back wall 71 may also be covered at least partially I the permeable membrane. FIG. 7 schematically illustrates the condensation of vapor into liquid droplets 72 along back wall 71 and drainage of the droplets 72 down back wall 71.

FIG. 7 further shows indents 74 which are configured to slide over pegs 28 (FIG. 2). Indent guards 75 at least partially enclose indents 74 to securely hold pegs 28 within indents 74.

Each of the right and left side drawer compartments houses a crisper drawer 25 and 26. Each crisper drawer 25 and 26 is sized to fit removably within the right and left side drawer compartments, respectively. Each crisper drawer 25 and 26 is made of two side walls 40*a*, a back wall 40*b*, a front wall 40*c* and a floor 40*d*. In some embodiments, the front wall is formed to include a recessed handle 76.

Referring again to FIG. 4, in some embodiments, a lift off bin 40 may be housed on a top surface of upper shelf 47. Lugs 43, extending from each back corner of upper shelf 47. Lugs 43 are configured to fit within slots 45 which are formed on lower back corners of lift off bin 40. Lift off bin 40 may optionally include one or more pairs of rails 49 on an inside surface of the front wall 40*c* and an inside surface of a back wall 40*b* of the lift off bin 40. One or more bin dividers 41 may be installed over a pair of rails 49 (one rail on the back wall 40*b* of the lift off bin facing a rail on the front wall 40*c* of the lift off bin) to divide lift off bin 40 into more than one section.

As seen in FIGS. 5 and 6, each side wall of each crisper drawer 25 and 26 further comprises an outwardly extending dowel 11 at a lower front portion of each side wall of each crisper drawer. Each dowel 11 is configured to interlock with niches 29 on interior surfaces of the side walls 31 and 33 and on each surface of the intermediate wall 33. Each side wall of each crisper drawer 25 and 26 further comprises an outwardly extending dowel 27 at an upper back portion of the side wall. Each dowel 27 is configured to fit and move within a track 55 located on interior surfaces of the side walls 31 and 33 and each surface of intermediate wall 32. Tracks 55 are curved, as shown in FIGS. 5 and 6. Curved tracks allow the crisper drawer to tilt forward and backward to open and close the crisper drawer for access by a user.

In a particular embodiment, each niche 29 on intermediate wall 32 includes an open upper surface. Such open upper surface allows the crisper drawer to be lifted up and removed from the crisper frame 30.

Crisper frame 30 further includes a front face 81 running across the width of the front upper edge 80. Front face 81 may optionally include a rubber gasket, foam padding, flexible or elastomeric material, or other like material or coating to form a seal against humidity and/or air circulation when the crisper drawers when in the closed position. Alternatively, front face 81 may include a closure strip or coating, such as a magnetic coating to prevent accidental opening of the drawer.

While illustrated on a fresh food compartment door 16 in the appended drawings, the on-door drawer may be utilized in a freezing compartment which includes a pivotally mounted door. When used in a freezing compartment, the frame may include solely right and left side walls with no intermediate wall. In such embodiments, only a single drawer may be utilized to fill the single compartment formed by the crisper frame. Likewise, use of a permeable membrane would be optional as would be the use of a packet containing ethylene absorbers, anti-oxidants or odor absorbers. When used in a freezing compartment, the on-door drawer could serve, in some embodiments, as a soft serve drawer, wherein frozen food requiring a milder level of freezing temperatures may be stored. Such frozen foods could include, for example, ice cream, frozen yogurt, and the like.

What is claimed is:

1. A refrigerating appliance comprising:

a cabinet;

a door pivotally mounted onto a front of the cabinet;

a crisper frame mounted to an inside surface of the door, the crisper frame comprising a back wall and two side walls and an intermediate wall forming two drawer compartments, a roof section including at least one through opening over each drawer compartment, and an upper shelf lying above the roof section and connected to the crisper frame at each of the two side walls;

wherein the upper shelf includes a pocket;

wherein the roof section includes at least one opening near the vertical intermediate wall and communicating with a chimney structure connecting the two drawer compartments with the pocket; and two crisper drawers, each crisper drawer configured to removably fit within one of the two drawer compartments and comprising two side walls, a back wall, a front wall and a bottom wall.

2. The refrigerator of claim 1, further including a packet which contains one or more selected from the group of ethylene absorbers, anti-oxidants, and odor removers in the pocket.

3. The refrigerator of claim 1, wherein the roof section includes vents forming a fluid communication between the crisper drawers and a space between the roof section and a lower surface of the upper shelf.

4. The refrigerator of claim 1, further comprising a permeable membrane on all or part of an upper surface of the roof section.

5. The refrigerator of claim 4, further comprising a permeable membrane along all or part of an outer surface of a back wall of the crisper frame.

6. The refrigerator of claim 1, further comprising a lift off bin configured to fit on top of the upper shelf.

7. The refrigerator of claim 6, further comprising an upwardly extending lug located on each back corner of the upper shelf, and wherein the lift off bin comprises two side walls, back and front walls and a floor, wherein each side wall includes a slot configured to interlock with one of the upwardly extending lugs.

8. The refrigerator of claim 7, further comprising a plurality of vertical rib pairs on the front and back walls of the lift off bin, wherein each rib pair is configured to interlock with a removable bin divider.

9. The refrigerator of claim 1, wherein all or part of a front face of a forward upper edge of the crisper frame further comprises a sealing material.

10. The refrigerator of claim 9, wherein the front face of each crisper drawer further comprises a handle on the front wall of the crisper drawer.

11. The refrigerator of claim 9, wherein each side wall of each crisper drawer further comprises an outwardly extending dowel at a lower front portion of the side wall, each dowel configured to interlock with niches in the side walls and intermediate wall of the crisper frame.

12. The refrigerator of claim 11, wherein each side wall of each crisper drawer further comprises an outwardly extending dowel at an upper back portion of the side wall, each dowel configured to fit and move within a track located on the side walls and intermediate wall of the crisper frame.

13. The refrigerator of claim 12, wherein the tracks are curved, thereby allowing the crisper drawer to tilt forward and backward to open and close the crisper drawer.

14. The refrigerator of claim 11, wherein each niche in the side walls and intermediate wall of the crisper frame include an open upper surface, thereby allowing the crisper drawer to be lifted up and removed from the crisper frame.

15. The refrigerator of claim 1, wherein the pocket further comprises a cover and the cover is configured to securely and removably house a packet.

16. The refrigerator of claim 1, wherein the door includes a door liner with two side flanges, each side flange including one or more pegs and wherein an outer surface of the crisper frame further comprises indentations configured to interlock with the pegs, thereby making the crisper frame removable from the door.

17. The refrigerator of claim 1, wherein the side walls, front wall, back wall and bottom wall of each crisper drawer is constructed of a transparent material.

18. The refrigerator of claim 10, wherein the handle is made of extruded aluminum.

19. The refrigerator of claim 1, wherein the roof section curves downwardly and backwardly from a front upper edge of the crisper frame.

* * * * *